US008027478B2

(12) United States Patent
Barry et al.

(10) Patent No.: US 8,027,478 B2
(45) Date of Patent: Sep. 27, 2011

(54) METHOD AND SYSTEM FOR SOUND SOURCE SEPARATION

(75) Inventors: Dan Barry, Clondalkin (IE); Robert Lawlor, Naas (IE); Eugene Coyle, Drogheda (IE)

(73) Assignee: Dublin Institute of Technology, Dublin (IE)

( * ) Notice: Subject to any disclaimer, the term of this patent is extended or adjusted under 35 U.S.C. 154(b) by 711 days.

(21) Appl. No.: 11/570,326

(22) PCT Filed: Apr. 18, 2005

(86) PCT No.: PCT/EP2005/051701

§ 371 (c)(1),
(2), (4) Date: Nov. 4, 2008

(87) PCT Pub. No.: WO2005/101898

PCT Pub. Date: Oct. 27, 2005

(65) Prior Publication Data

US 2009/0060207 A1 Mar. 5, 2009

(30) Foreign Application Priority Data

Apr. 16, 2004 (IE) ..... S2004/0271
Nov. 5, 2004 (EP) ..... 04105570

(51) Int. Cl.
*H04R 5/00* (2006.01)

(52) U.S. Cl. ..... 381/17

(58) Field of Classification Search ..... 381/17, 381/1, 2, 10, 56, 58, 123; 700/94
See application file for complete search history.

(56) References Cited

U.S. PATENT DOCUMENTS

| | | | | |
|---|---|---|---|---|
| 6,405,163 | B1 | 6/2002 | Laroche | |
| 6,430,528 | B1 | 8/2002 | Jourjine et al. | |
| 6,535,608 | B1 * | 3/2003 | Taira | 381/2 |
| 7,391,870 | B2 * | 6/2008 | Herre et al. | 381/23 |
| 7,567,845 | B1 * | 7/2009 | Avendano et al. | 700/94 |
| 7,672,466 | B2 * | 3/2010 | Yamada et al. | 381/94.7 |
| 7,734,473 | B2 * | 6/2010 | Schuijers et al. | 704/503 |
| 2002/0133333 | A1 | 9/2002 | Ito et al. | |
| 2003/0233227 | A1 | 12/2003 | Rickard, Jr. et al. | |

OTHER PUBLICATIONS

PCT International Search Report PCT/EP2005/051701; Nov. 8, 2005.

Avendano "Frequency-Domain Source Identification and Manipulation in Stereo Mixes for Enhancement, Suppression and Re-Panning Applications: Applications of Signal Processing to Audio and Acoustics"; 2003; IEEE Workshop on Applications of Signal Processing to Audio and Acoustics; Oct. 19, 2003; pp. 55-58; IEEE; NJ, USA.

Barry, et al. "Sound Source Separation: Azimuth Discrimination and Resynthesis"; Proceedings of the 7th Int. Conference on Digital Audio Effects; http://www.dmc.dit.ie/2002/research_ditme/dnbarry/DanBarryDAFX04.pdf. Oct. 5, 2004; pp. 1-5; Naples, IT.

* cited by examiner

*Primary Examiner* — Curtis Kuntz
*Assistant Examiner* — Hai Phan
(74) *Attorney, Agent, or Firm* — Hogan Lovells US LLP

(57) ABSTRACT

Methods of sound source separation in which individual sources are extracted from a multiple source recording, include a method of analyzing stereo recordings to facilitate separation of individual musical sound sources from stereo music recordings. In the method sources predominant in the left are treated in a different manner to sources in the right.

19 Claims, 7 Drawing Sheets

METHOD AND SYSTEM FOR SOUND SOURCE SEPARATION

FIELD OF THE INVENTION

The present invention relates generally to the field of audio engineering and more particularly to methods of sound source separation, where individual sources are extracted from a multiple source recording. More specifically, the present invention is directed at methods of analysing stereo signals to facilitate the separation of individual musical sound sources from them.

BACKGROUND OF THE INVENTION

Most musical signals, for example as might be found in a recording, comprise a plurality of individual sound sources including both instrumental and vocal sources. These sources are typically combined into a two channel stereo recording with a Left and a Right Signal.

There are several applications where it would be advantageous if the original sound sources could be individually extracted from the Left and Right Signals. Traditionally, one area where a form of sound source separation has been used is in the field of karaoke entertainment. In karaoke a singer performs live in front of an audience with background music. One of the challenges of this activity is to come up with the background music, i.e. get rid of the original singer's voice to retain only the instruments so the amateur singer's voice can replace that of the original singer and be superimposed with the backing track. One way in which this can be achieved uses a stereo recording and the assumption (usually true) that the voice is panned in the centre (i.e. that the voice was recorded in mono and added to the Left and Right channels with equal level). In such cases, the voice content may be significantly reduced by subtracting the Left channel from the Right channel, resulting in a mono recording from which the voice is nearly absent. It will be appreciated that the voice signal is not completely removed because as stereo reverberation is usually added after the mix, a faint reverberated version of the voice remains in the difference signal. There are however several drawbacks to this technique including that the output signal is always monophonic. It also does not facilitate the separation of individual instruments from the original recording.

U.S. Pat. No. 6,405,163 describes a process for removing centrally panned voice in stereo recordings. The described process utilizes frequency domain techniques to calculate a frequency dependent gain factor based on the difference between the frequency-domain spectra of the stereo channels. The described process also provides for the limited separation of a centrally panned voice component from other centrally panned sources, e.g. drums, using typical frequency characteristics of voice. A drawback of the system is that it is limited to the extraction of centrally panned voice in a stereo recording.

Another known technique is that of DUET (Degenerate Unmixing and Estimation Technique) described inter alia in A. Jourjine, S. Rickard and O. Yilmaz. "Blind Separation of Disjoint Orthoganal Signals: Demixing N Sources from 2 mixtures" Proc. ICASSP 2000, Istanbul, Turkey, A. Jourjine, S. Rickard and O. Yilmaz. "Blind Separation of Disjoint Orthoganal Sources" Technical Report SCR-98-TR-657, Siemens Corporate Research, 755 College Road East, Princeton, N.J., September 1999 and S. Rickard, R. Balan, J. Rosca. "Real-Time Time-Frequency Based Blind Separation" Presented at the ICA2001 Conference, 2001 San Diego Calif. DUET is an algorithm, which is capable of separating N sources which meet the condition known as "W-Disjoint Orthoganality", (further information about which can be found in S. Rickard and O. Yilmaz, "On the Approximate W-Disjoint Orthoganality of Speech" IEEE International Conference on Acoustics, Speech and Signal Processing, Florida, USA, May 2002, vol. 3, pp. 3049-3052) from two mixtures. This condition effectively means that the sources do not significantly overlap in the time and frequency domain. Speech generally approximates this condition and so DUET is suitable for the separation of one person's speech from multiple simultaneous speakers. Musical signals however do not adhere to the W-Disjoint Orthoganality condition. As such, DUET is not suitable for the separation of musical instruments.

The present invention is directed at conventional studio based stereo recordings. Studio based stereo recordings account for the majority of popular music recordings. Studio recordings are (usually) made by first recording N sources to N independent audio tracks, the independent audio tracks are then electrically summed and distributed across two channels using a mixing console. Image localisation, referring to the apparent location of a particular instrument/vocalist in the stereo field, is achieved by using a panoramic potentiometer (pan pot). This device allows a single sound source to be divided into two channels with continuously variable intensity ratios. By using this technique, a single source may be virtually positioned at any point between the speakers. The localisation is achieved by creating an Interaural Intensity Difference, (IID), and this is a well known phenomenon. The pan pot was devised to simulate IID's by attenuating the source signal fed to one reproduction channel, causing it to be localised more in the opposite channel. This means that for any single source in such a recording, the phase of a source is coherent between Left and Right channels, and only its intensity differs.

C. Avendano, "Frequency-Domain Source Identification and Manipulation in Stereo Mixes for Enhancement, Suppression and Re-Panning Applications" IEEE WASPAA'03 describes a method which is directed at studio based recordings. The method uses a similarity measure between the Short-time Fourier Transforms of the Left and Right input signals to identify time-frequency regions occupied by each source based on the panning coefficient assigned to it during the mix. Time-frequency components are then clustered based on a given panning coefficient, and re-synthesised.

The Avendano method assumes that the mixing model is linear, which is the case for "studio" or "artificial" recordings which, as discussed above, account for a large percentage of commercial recordings since the advent of multi-track recording. The method attempts to identify a source based on its lateral placement within the stereo mix. The method describes a cross channel metric referred to as the "panning index" which is a measure of the lateral displacement of a source in the recording. The problem with the panning index is that it returns all positive values, which leads to "lateral ambiguity", meaning that the lateral direction of the source is unknown, i.e. a source panned 60 degrees Left will give an identical similarity measure if it was panned 60 degrees Right. To address this shortcoming, the Avendano paper proposes the use of a partial similarity measure and a difference function.

Despite the solutions provided, a significant problem with this approach is that a single time frequency bin is considered as belonging to either a source on the Left or a source on the Right, depending on its relative magnitude. This means that a source panned hard Left will interfere considerably with a source panned hard Right. Furthermore, the technique uses a masking method that means that the original STFT bin magnitudes are used in the re-synthesis which will cause significant interference from any other signal whose frequencies overlap with the source of interest.

Accordingly, there is a need for an alternative method of stereo analysis, which facilitates sound source separation, and which overcomes at least some of the previously described problems.

SUMMARY OF THE INVENTION

The present invention seeks to solve the problems of the prior art methods and systems by treating sources predominant in the Left in a different manner to sources in the Right. The effect of this is that during a subsequent separation process a source in the Left will not substantially interfere with a source in the Right.

Accordingly, a first embodiment of the invention provides a method of modifying a stereo recording for subsequent analysis. The stereo recording comprises a first channel signal and a second channel signal (e.g. LEFT and RIGHT stereo signals). The method comprises the steps of; converting the first channel signal into the frequency domain, converting the second channel signal into the frequency domain, defining a set of scaling factors, and producing a frequency azimuth plane by 1) gain scaling the frequency converted first channel by a first scaling factor selected from the set of defined scaling factors, 2) subtracting the gain scaled first signal from the second signal, 3) repeating steps 1) and 2) individually for the remaining scaling factors in the defined set to produce the frequency azimuth plane which represents magnitudes of different frequencies for each of the scaling factors and which may be used for subsequent analysis.

The step of producing the frequency azimuth plane may comprise the further steps of 4) gain scaling the frequency converted second signal by the first scaling factor, 5) subtracting the gain scaled second signal from the first signal, 6) repeating steps 4) and 5) individually for the remaining scaling factors in the defined set and combining the resulting values with the previously determined values to produce the frequency azimuth plane. A graphical representation of the produced frequency plane may be displayed to a user. The method may further comprise the steps of determining a maximum value for each frequency in the frequency azimuth plane and subtracting individual frequency magnitudes in the frequency azimuth plane from the determined maxi mum values to produce an inverted frequency azimuth plane. A graphical representation of the inverted frequency azimuth plane may be displayed to the user in which the inverted azimuth plane is defined by determining a maximum value for each frequency in the frequency azimuth plane and subtracting individual frequency magnitudes in the frequency azimuth plane from the determined maximum values. Suitably, a window may be applied to the inverted frequency azimuth plane to extract frequencies associated with a particular scaling factor. These extracted frequencies may be converted into a time domain representation. A threshold filter may be applied to reduce noise prior to conversion into the time domain. Advantageously, the defined set of scaling factors may be in the range from 0 to 1 in magnitude. The spacing between individual scaling factors may be uniform. Suitably, the individual steps of the method are performed on a frame by frame basis.

Another embodiment of the invention provides a sound analysis system comprising: an input module for accepting a first channel signal and a second channel signal (e.g. LEFT/RIGHT signals from an stereo source), a first frequency conversion engine being adapted to convert the first channel signal into the frequency domain, a second frequency conversion engine being adapted to convert the second channel signal into the frequency domain, a plane generator being adapted to gain scale the frequency converted first channel by a series of scaling factors from a previously defined set of scaling factors and combining the resulting scale subtracted values to produce a frequency azimuth plane which represents magnitudes of different frequencies for each of the scaling. The input module may comprise an audio playback device, for example a CD/DVD player. A graphical user interface may be provided for displaying the frequency azimuth plane. The plane generator may be further adapted to gain scale the frequency converted second signal by the first scaling factor and to subtract the gain scaled second signal from the first signal and to repeat this individually for the remaining scaling factors in the defined set and to combine the resulting values with the previously determined values to produce the frequency azimuth plane.

The plane generator may be further adapted to determine a maximum value for each frequency in the frequency azimuth plane and to subtracting individual frequency magnitudes in the frequency azimuth plane from the determined maximum values to produce an inverted frequency azimuth plane. The sound analysis system may provide a graphical user interface for displaying the inverted frequency azimuth plane. The sound analysis system may further comprising a source extractor adapted to apply a window to the inverted frequency azimuth plane to extract frequencies associated with a particular scaling factor. A further means may be provided for converting the extracted frequencies into a time domain representation, in which case a threshold filter may be provided for reducing noise prior to conversion into the time domain. Suitably, the defined set of scaling factors are in a range between 0 and 1 in magnitude and/or has uniform spacing between individual scaling factors. Advantageously, the elements of the system processing the audio data may operate on a frame by frame basis.

BRIEF DESCRIPTION OF THE DRAWINGS

The present invention will now be described with reference to the accompanying drawings in which.

DETAILED DESCRIPTION OF THE DRAWINGS

Figure 1:
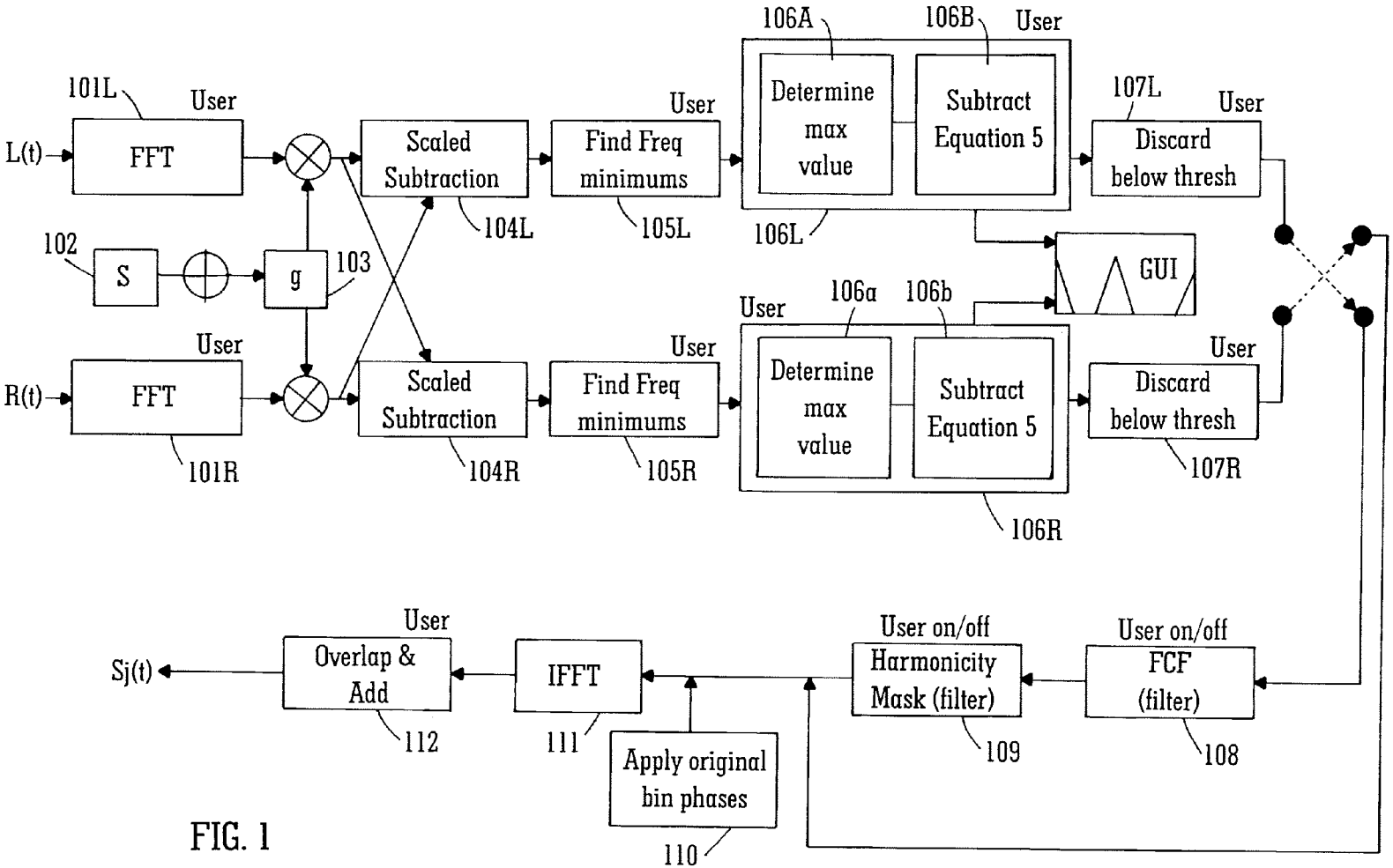
FIG. 1 is a block diagram of an exemplary implementation of the present invention.
Figure 4:
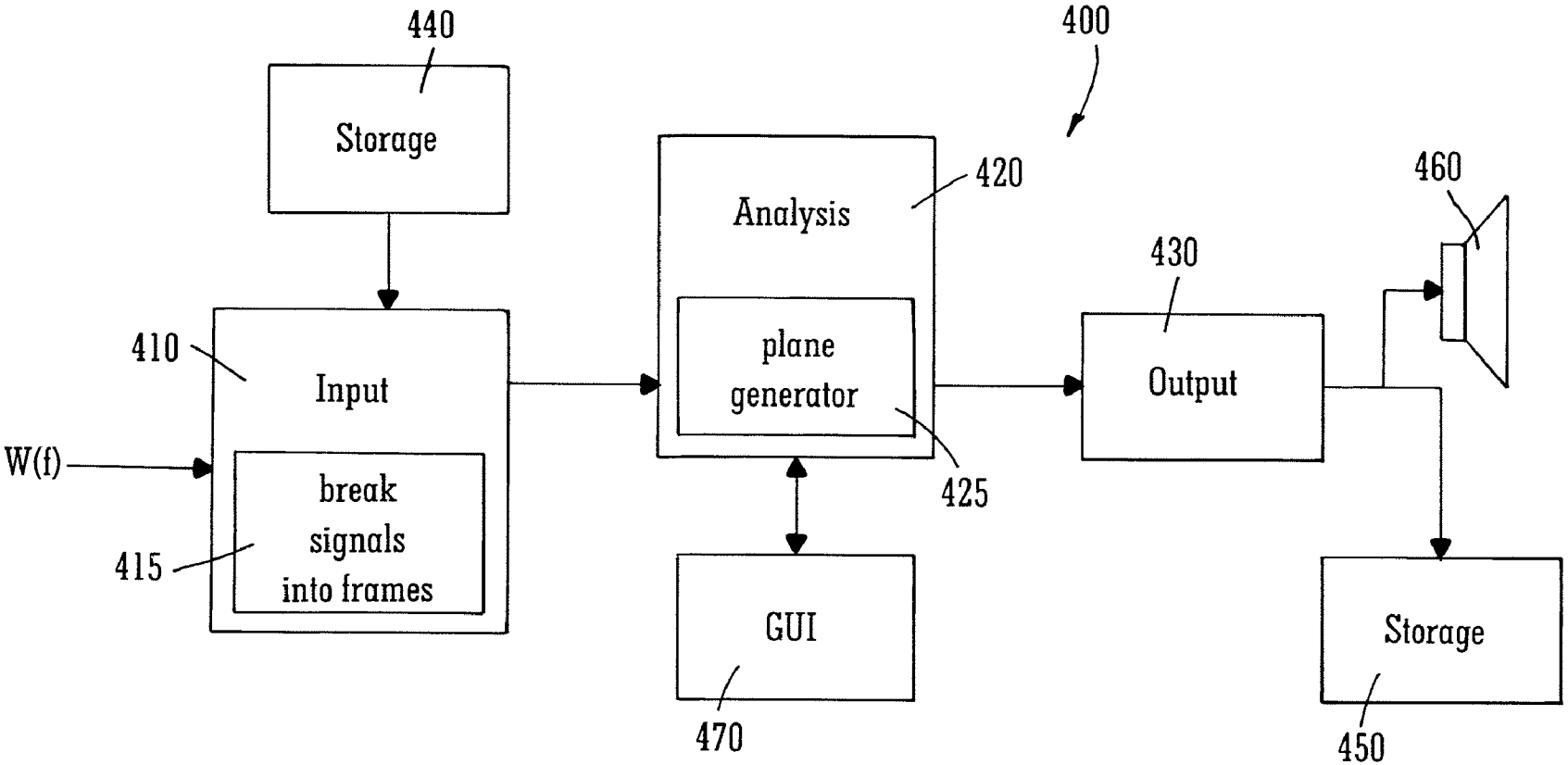
FIG. 4 is an exemplary block diagram showing an overview of the elements of an exemplary system incorporating the implementation of FIG. 1.

FIG. 4 is an exemplary block diagram showing an overview of the elements of a source identification system 400 incorporating the implementation of FIG. 1. Referring to FIG. 4, a source identification system 400 includes an input module 410, an analysis module 420 and an output module 430. Desirably the system additionally includes a GUI 440. Each of the modules are desirably provided in software/hardware or a combination of the two. By inputting a stereo music recording into the system, for example from a storage device 440, of the present invention it is possible to provide as an output a graphic representation of the components sources of that recording and/or to individually select one or more of the component sources for further processing. This further processing may be used to output extracted sources from the stereo music recording, which in turn may be stored on a storage system 450 or an output device, e.g. speaker 460. A graphical user interface 470 may be provided to display the graphic representation on screen to a user and/or to accept user inputs to control the operation of the system.

As detailed above, the system of the present invention provides an input module 410, which accepts first and second channel signals L(t) and R(t) from a stereo source. These first and second channels are typically referred to as Left and Right. The input module 410 may for example comprise software running on a personal computer retrieving the Left and Right signals from a stored stereo recording on a storage device 440 associated with the computer, e.g. a hard disk or a CD player. Alternatively, the input module 410 may have analog inputs for the Left and Right signals. In this case, the input module 410 would comprise suitable analog to digital circuitry for converting the analog signals into digital signals.

Suitably, the input module 410 breaks the received digital signals into a series of frames 415 to facilitate subsequent processing. Suitably, the individual time frames overlap, as for example in the same fashion as the well known Phase Vocoder technique. A suitable window function W(f) may be applied to the individual frames in accordance with techniques familiar to those skilled in the art, for example each of the overlapping frames may be multiplied by a Hanning window function. The input module 410 is further adapted to transform the individual frames of the Left and Right channels from the time domain into the frequency domain using a FFT (Fast Fourier Transform), FIG. 1 (101L, 101R). Conversion of the Left and Right signals into the frequency domain facilitates the subsequent processing of the signal. Such techniques are well known and in the art. The process of creating overlapping frames, applying a window W(f) and conversion into the frequency domain is known as the STFT (Short-time Fourier Transform). The input module 410 provides the frequency domain equivalents of the inputted Left and Right audio signals in the rectangular or complex form as outputs. The outputs of the input module 410, we will call [Lf] and [Rf] for Left and Right respectively.

The Left and Right signals are provided from the input module 410 to a subsequent analysis module 420. The analysis module may, for example, be implemented as software code within a personal computer. In accordance with the present invention, the analysis module 420 accepts the Left and Right frequency domain frames from the input module and creates a 'frequency-azimuth plane' using a plane generator 425. This frequency azimuth plane identifies specific frequency information for a range of different azimuth positions. An azimuth position refers to an apparent source position between the Left and Right speakers during human audition. The frequency-azimuth plane is 3-dimensional and contains information about frequency, magnitude and azimuth. The method of creation of the frequency azimuth plane will be described in greater detail below.

Once created the azimuth plane may be processed further to provide additional information. However, it will be understood by those skilled in the art that the created frequency azimuth plane is, in itself, a useful tool for analysis of an audio source as it provides a user with a significant amount of information about the audio contents. Accordingly, the created frequency azimuth plane information may be provided as an output from the system. One example of how this may be outputted is a graphical representation on a user's display 470.

Optionally, therefore the system may include a display module, for accepting user input through a graphical user interface and/or displaying a graphical representation of the created frequency azimuth plane. One use of this may be with audio playback devices which include a visual representation of the audio content, for example as a visualisation pane in MICROSOFT WINDOWS media player, or as a visualisation in REAL player.

Figure 2A:
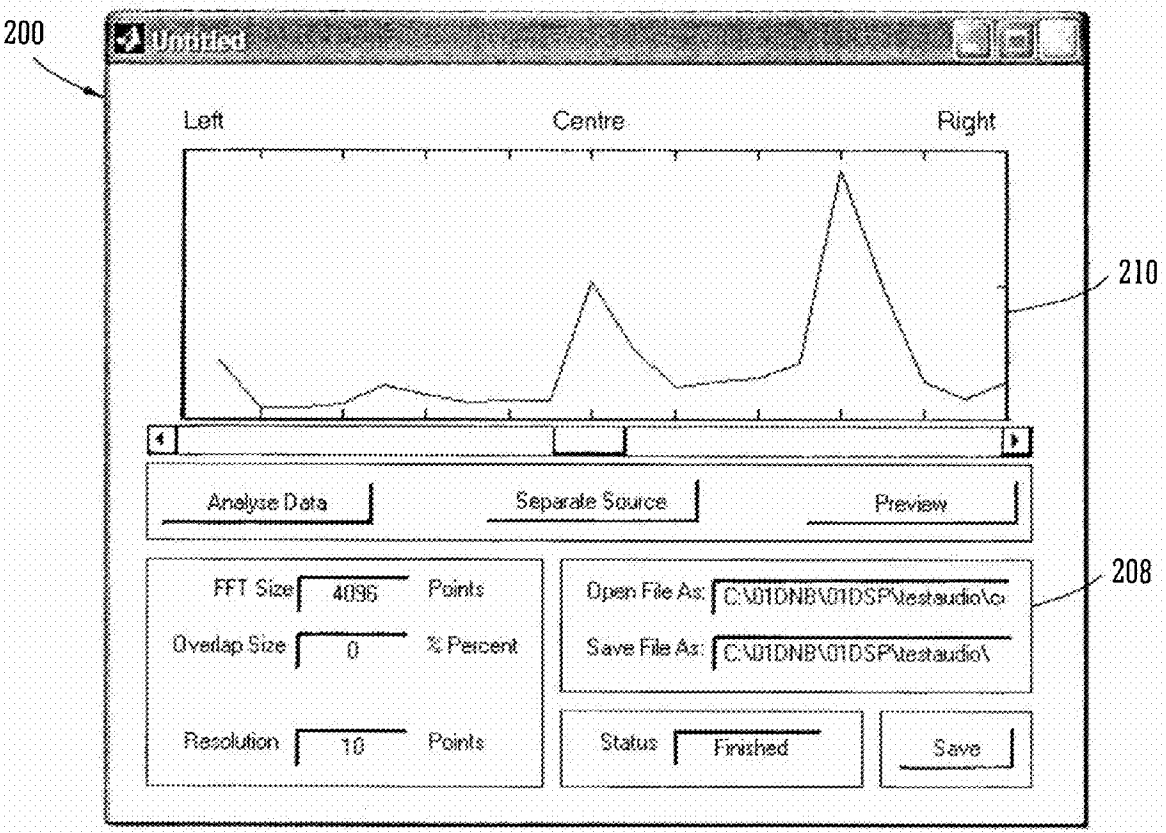
FIGS. 2A and 2B illustrate exemplary user interfaces according to the invention.
Figure 2B:
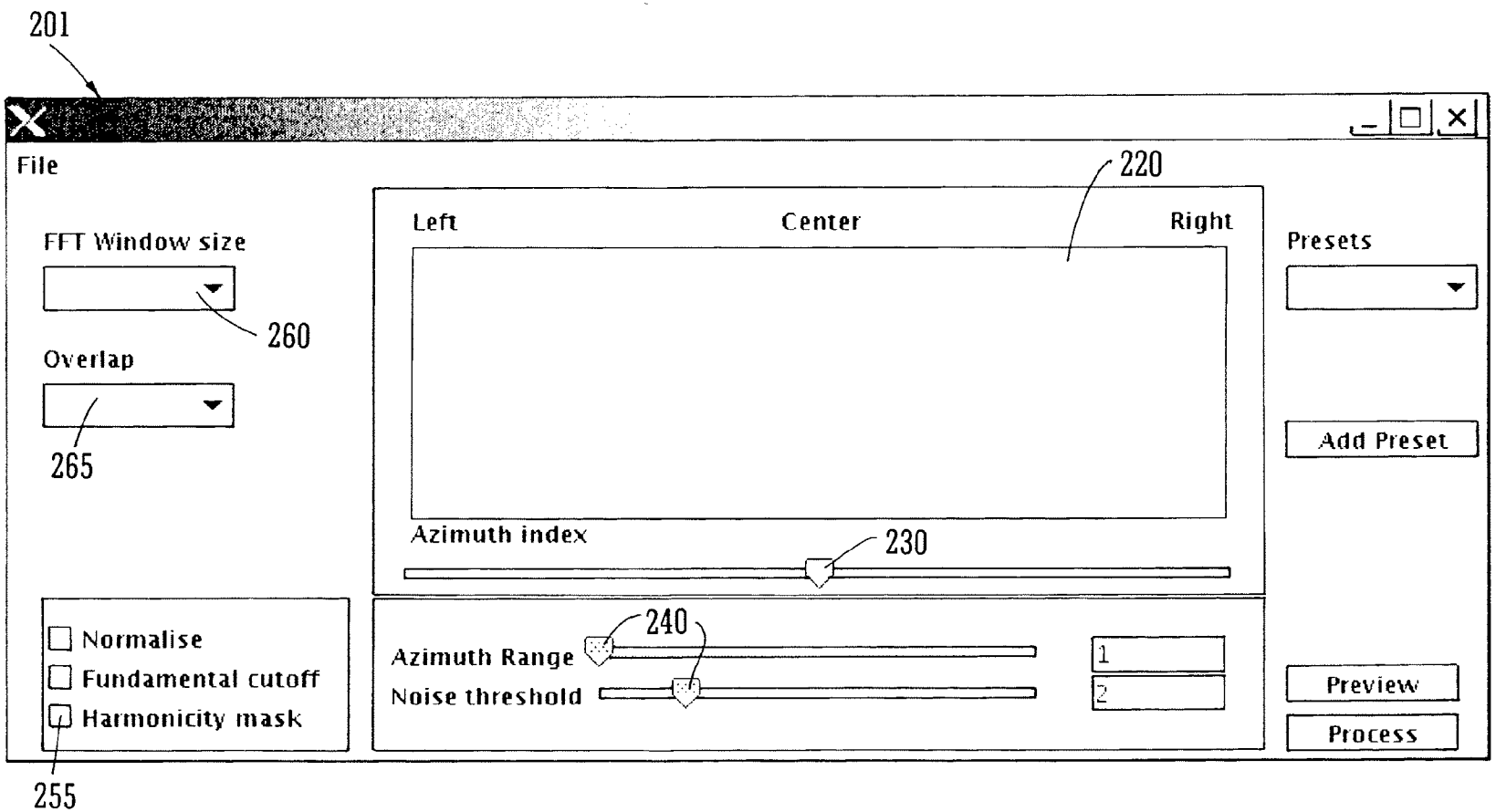

The graphical user interface 200, 201, examples of which are shown in FIGS. 2A and 2B, may also be configured in combination with user input devices, e.g. keyboard, mouse, etc., to allow the user to control the operation of the system. For example, the GUI may provide a function 208 to allow the user to select the audio signals from a variety of possible inputs, e.g. different files stored on a hard disk or from different devices. The azimuth plane may also be displayed 210, 220 to allow a user identify a particular azimuth from which sources may be subsequently extracted (discussed in detail below). The three dimensional azimuth plane may be displayed in as three dimensional representation or as a two dimensional view where frequency information is omitted.

In this scenario, the created azimuth plane is used as an input into a further stage of analysis in the analysis module 420 from which the output(s) would be a source separated version of the input signals, i.e. a version of the input signals from which one or more sources have been removed. The output signal may simply contain a single source, i.e. all other sources bar one have been removed. The particular method of separation used by the analysis module 420 will be described in greater detail below.

Once a source has been separated/extracted, the analysis module 420 may pass the separated/extracted signals to an output module 430. The output module 430 may then convert these separated signals into a version suitable for an end user. In particular, the output module 430 is adapted to convert the signal from the frequency domain into the time domain, for example, using an inverse fast Fourier transform (IFFT) 111 and the overlapping frames combined into a continuous output signal in digital form in the time domain ($S_j(t)$) using for example a conventional overlap and add algorithm 112. This digital signal may be converted to an analog signal and outputted to a loudspeaker 460 or other audio output device for listening by a user. Similarly, the outputted signal may be stored on a storage medium 450, for example a CD or hard disk. Depending on the application, there may be a plurality of outputs, i.e. where a plurality of sources are simultaneously extracted by the system. In this scenario, each separate output may for example be stored as an individual track in a multi-track recording format for subsequent re-mixing.

The system of the present invention which may operate either in an automated or in a semi automated way in conjunction with a user's input is suitable for extracting a single sound source (e.g. a musical instrument) from a recording containing several sound sources (e.g. several instruments and/or vocalists). This means that, the user can choose to listen to (and further process) only one instrument selected from a group of similar sounding instruments. Having separated out only one or more individual sources, the sources may be independently processed of all others, which facilitates its application to a number of areas including:

a) music transcription systems, b) analysis of isolated instruments within a composite recording c) sampling specific audio in a composite recording d) remixing recordings e) conversion of Stereo audio into 5.1 surround sound through the use of up-mixing Conversely, one or more sources may be suppressed, leaving all other sources intact, effectively muting that source (instrument). This is applicable in fields including that of karaoke entertainment.

Another application is that known as the MMO format, 'Music Minus One', whereby recordings are made without the soloist, so that a performer may rehearse along with an accompaniment of the specific musical piece. The present method is particularly suited to removing the soloist from a conventional studio recording, which obviates the necessity to provide specific recording formats for practising purposes.

The method of the invention will now be explained with reference to the flow sequence of FIG. 1. The Left and Right channels are initially converted 101L, 101R from the time domain into frequency domain representations. The method works by applying gain scaling 103 to one of the two channels so that a particular source's intensity becomes equal in both Left and Right channels. A simple subtraction of the channels will cause that source to substantially cancel out due to phase cancellation. The cancelled source may be recovered by firstly creating a "frequency-azimuth" plane and then analysing the created plane for local minima along an azimuth axis. These local minima may be taken to represent points at which some gain scalar caused phase cancellation for some source. It is submitted that at some point where an instrument or source cancels, substantially only the frequencies which it contained will show a local minima. The magnitude and phase of these minima are then estimated and an IFFT in conjunction with an overlap and add scheme may be used to resynthesise the cancelled instrument.

The method invention will now be described in greater detail with reference to the extraction of sources from a conventional studio stereo recording. The mixing process for a conventional stereo studio recording may be expressed generally as, $$X(t) = \sum_{j=1}^{J} Px_j S_j(t) \tag{1}$$

where $S_j$ represents j independent sources, $P_{xj}$ is the panning co-efficient for the $j^{th}$ source where x and X are used to signify, Left ($P_{lj}$, L(t)) or Right ($P_{rj}$ t, R(t)). The L(t) and R(t) signals represent the Left and Right signals provided in conventional stereo recordings and which are generally played back in Left hand positioned and Right hand positioned speakers respectively. Thus for example the Left channel may be represented as $$L(t) = \sum_{j=1}^{J} Pl_j S_j(t).$$

The method of the present invention assumes that the source material is a typical stereo recording and using the Left and Right channels L(t), R(t) from such source material as its inputs attempts to recover the independent sources or musical instruments $S_j$. As explained above, the input module may retrieve the Left and Right signals from a stored stereo recording on a CD or other storage medium.

Although, equation 1 is a representation of the contributions from all sources to the Left and Right channels, it may be observed from equation 1 that the intensity ratio (g) of a particular source (for example the $j^{th}$ source g(j)), between the Left and Right channels may be expressed as the following:

$$g(j) = \frac{Pl_j}{Pr_j} \tag{2}$$

Thus if the Right channel, R is gain-scaled 103 by the intensity ratio g(j), the intensity levels of the $j^{th}$ source will be equal in the Left and Right channels. Similarly, since L and R are simply the superposition of the scaled sources, the subtraction of the gain-scaled Right channel from the Left channel ($L-g_{(j)}.R$) will cause the $j^{th}$ source to cancel out. For practical reasons, subtraction 104L,104R of a gain-scaled Right channel from the Left channel ($L-g_{(j)}.R$) is used if a source i.e. the $j^{th}$ source) is predominant in the Right channel and subtraction of a gain-scaled Left channel from the Right channel ($R-g_{(j)}.L$), may be used where the $j^{th}$ source is predominant in the Left channel. The use of two separate functions for sources from the Left and Right channels provides a number of advantages. Firstly, it ensures a limited range for the gain scaling value g(j), which is between zero and one ($0 \leqq g(j) \leqq 1$). Secondly, it ensures that one channel is always being scaled down in order to match the intensities of a particular source, thus avoiding distortion caused by large scaling factors. This is the essential basis of the method adopted by the present invention to extract/separate sound sources.

For practical reasons, the method of the present invention is performed in the frequency domain. Thus a first step in the method is the conversion of the Left and Right channel signals into the frequency domain. Similarly, for practical reasons the Left and Right are broken up into overlapping time frames and each frame also has a suitable window function applied, for example by multiplication of a Hanning window function. These latter steps are performed before the conversion into the frequency domain. The steps of frequency domain conversion, creating overlapping frames and applying a window function are, as described above, performed by the input module. Optionally, the user may be provided with controls 260, 265 in the graphical user interface to set the FFT window size and the degree of overlap between adjoining frames.

After conversion, the Left and Right audio channels are now in the frequency domain, preferably for computational reasons in the rectangular or complex form. The frequency domain representations of the Left and Right channels will be indicated as [Lf] and [Rf] for the Left and Right channels respectively.

The frequency domain representations of the Left and Right channels may then be used to create a 'frequency-azimuth plane'. In the context of the present invention, the term frequency azimuth plane is used by the inventors to represent a plane identifying the effective direction from which different frequencies emanate in a stereo recording. For the purposes of creating the frequency azimuth plane, only magnitude information is used. Phase information for the Left and Right channels is not used in the creation of the frequency azimuth plane. Nonetheless, the phase information is retained for the subsequent recreation of a sound source. The created frequency-azimuth plane contains information identifying frequency information at different azimuth positions. An azimuth position refers to an apparent source position between the Left and Right speakers during human audition. The frequency-azimuth plane is mathematically three dimensional in nature and contains information about frequency, magnitude and azimuth.

The frequency azimuth plane may comprise a single representation corresponding to azimuths in either the Left or Right directions. Alternatively, the frequency azimuth plane may represent azimuths in both the Left and Right directions. In the latter case, azimuth planes may be calculated separately for the Left and Right directions and then combined to produce an overall azimuth plane with both Left and Right azimuths.

With reference to FIG. 1 (102, 103, 104), an exemplary frequency azimuth plane may be created using the exemplary method which follows:

Taking the Right channel as the reference channel, the function in Eq. 3 is performed, $$AZ_{R(k,\,i)}=|Lf_{(k)}-g_{(i)}Rf_{(k)}| \tag{3a}$$

$$AZ_{R(k,\,i)}=|Rf_{(k)}-g_{(i)}Lf_{(k)}| \tag{3b}$$

where $$g(i)=(i)\frac{1}{\beta} \tag{4}$$

for all i where $0 \leqq i \leqq \beta$, and where i and β are integer values. We refer to FIG. 1 (102), where $s=1/\beta$, and $g=g(i)$, from equation 4. The defined set of scaling factors g(i) are defined with reference to the 'azimuth resolution', β, which refers to how many equally spaced gain scaling values of g are to be used to construct the frequency-azimuth plane. Large values of β will lead to more accurate azimuth discrimination but will increase the computational load. Equation 3a and 3b together produce a frequency azimuth plane by gain scaling the frequency converted first channel by the first scaling factor $$\left(\text{e.g. } i=1,\ g(1)=(1)\times\frac{1}{\beta}\right)$$

selected from the set of defined scaling factors. Suitably, the scaling factors are configurable by the user through the graphical user interface, which may also display information relating to the scaling factors. This scaled channel is then subtracted from the second channel signal. These steps are then repeated for the remaining scaling factors in the defined set to produce the frequency azimuth plane. The frequency azimuth plane constructed using Equation 3a represents the magnitude of each frequency for each of the scaling factors in the first (right) channel. In particular, equation 3a constructs the frequency azimuth plane for the right channel only. The left channel frequency azimuth plane can be constructed using equation 3b. The complete frequency azimuth plane which spans from far left to far right is created by concatenating the right and left frequency azimuth planes.

Assuming an N point FFT, our frequency-azimuth plane will be an N×β array for each channel. Using suitable graphical subroutines, this three dimensional array may be represented graphically as an output or may be displayed using the graphical user interface. Within this frequency-azimuth plane, there are 'frequency dependent nulls', which signify a point at which some instrument or source cancelled during the scaled subtraction Eq 3 & 4, FIG. 1 (102, 103, 104). These nulls or minimums are located FIG. 1 (105L and 105R), by sweeping across the azimuth axis and finding the point at which the $K^{th}$ frequency bin experiences its minimum.

The amount of energy lost in one frequency bin due to phase cancellation is proportional to the amount of energy a cancelled source or instrument had contributed to that bin.

The magnitude for each bin at a particular azimuth point is estimated, FIG. 1 (106L and 106R), using the following equation:

$$AZ_{R(k,i)}=\begin{cases} AZ_{R(k)_{max}}-AZ_{R(k)_{min}}, & \text{if } AZ_{R(k,i)}=AZ_{R(k)_{min}} \\ 0, & \text{otherwise.} \end{cases} \tag{5}$$

Figure 3:
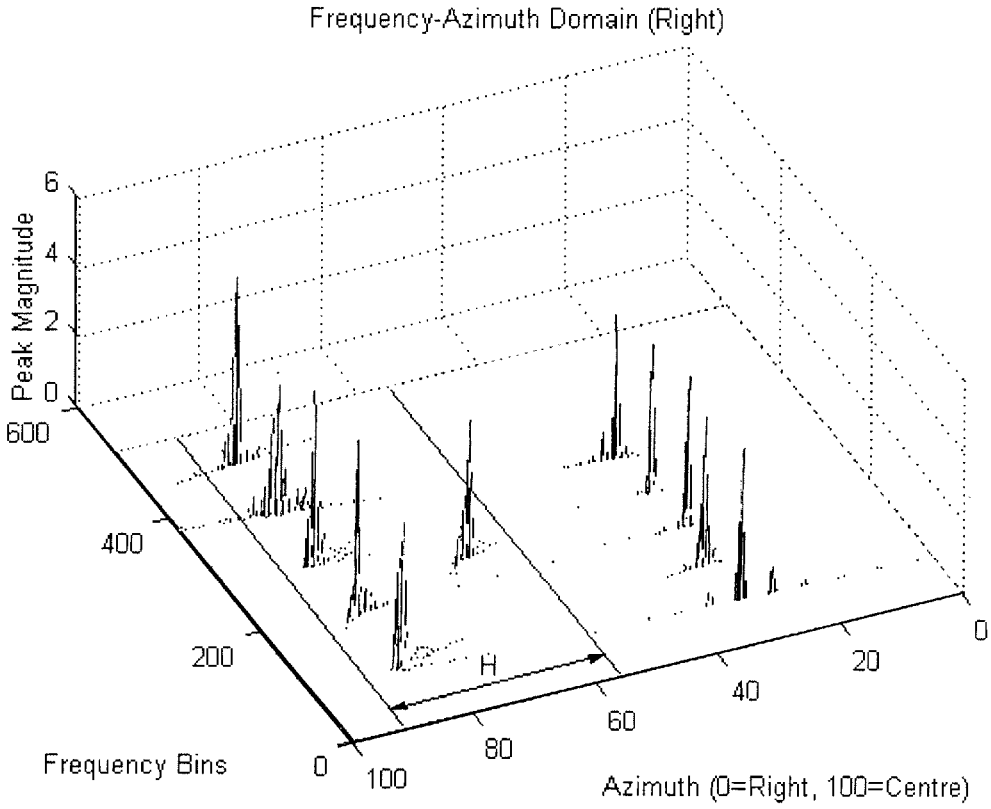
FIG. 3 is a graphical representation of an exemplary Frequency Azimuth Plane resulting from the invention.

An inverted frequency azimuth plane is produced by determining (106*a*) a maximum value for each frequency in the frequency azimuth plane and subtracting (106*b*) individual frequency magnitudes in the frequency azimuth plane from the determined maximum values. This process is effectively turning nulls or 'valleys' of the azimuth plane into peaks, effectively inverting the plane. In review, the energy assigned to a particular source is deemed to be the amount of energy which was lost in each bin, due to the cancellation of a particular source. Using Eq. 5, we have created an 'inverted frequency-azimuth plane' for the Right channel. (8) This inverted frequency azimuth plane (shown graphically by the example in FIG. 3) identifies the frequency contributions of the different sources. The exemplary representation in FIG. 3, shows the magnitudes at different frequency bins for different azimuths.

In order to separate out a single source or sources, the portion of the inverted frequency-azimuth plane corresponding to the desired source is re-synthesised. The re-synthesised portion is dependent upon two primary parameters, hereinafter referred to as the azimuth index and the azimuth subspace width. The azimuth index, d, (where $0 \leqq d \leqq \beta$) may be defined as the position (between Left and Right) from which the source will be extracted. The 'azimuth subspace width' H, (FIG. 3) refers to the width of the area for separation. Large subspace widths will contain frequency information from many neighbouring sources causing poor separation, whereas narrow subspace widths will result in greater separation but this may result in degradation of output quality.

In a user controlled system, these two parameters may be individually controllable by the user, for example through controls 230 on the GUI, in order to achieve the desired separation. In such a GUI, the user may be provided with a first control that allows them to pan for sources from left to right (i.e. change the azimuth index) and extract the source(s) from one particular azimuth. Another control may be provided to allow the user to alter the subspace width.

With such a control, the user may, for example, alter the subspace width based on audio feedback of the extracted source. Possibly, trying several different subspace widths to determine the optimum subspace width for audibility. Thus the azimuth index and subspace width may be set by the user such that the maximal amount of information pertaining to only one source (whilst rejecting other sources) is retained for resynthesis. Alternatively, the azimuth index and subspace widths may be pre-determined (for example in an automatic sound source extraction system).

Nonetheless, the advantage of the real-time interaction between the user and the system is that the user may make subtle changes to both these parameters until the desired separation can be heard.

With a value for each of these parameters, the 'azimuth subspace' for resynthesis can be calculated using Eq. 6. Essentially a portion of the inverted azimuth plane is selected.

$$Y_{R(k)} = \sum_{i=d-H/2}^{i=d+H/2} AZ_{R(k,i)} \quad 1 \le k \le N \tag{6}$$

The resulting portion is a 1×N array containing the power spectrum of the source which has been separated. This may be converted into the time domain for listening by a user.

To reduce unwanted artifacts, the array may be passed through a thresholding system, such as that represented by Eq. 7, so as to filter out any values below a user specified threshold. This thresholding system acts as a noise reduction process, FIG. 1 (107L and 107R).

$$Y_{R(k)} = \begin{cases} Y_{R(k)} & \text{if } Y_{R(k)} \ge \psi \\ 0, & \text{otherwise} \end{cases} \quad 1 \le k \le N \tag{7}$$

Where ψ is the noise threshold. Optionally, the noise threshold may be a user variable parameter for example by means of a control 240 in the graphical user interface, which may be altered to achieve a desired result. Significantly, the use of a noise threshold system can greatly improve the signal to noise ratio of the output.

In order to convert the extracted source from the frequency domain back into the time domain, the original phases from the frequency domain representation (FFT, FIG. 1 (101R)) of the channel which the instrument was most present (e.g. Right), are assigned (110) to each of the K frequency bins. This is required for a faithful resynthesis of the separated signal.

The extracted source may then be converted using conventional means into the time domain, for example by means of an IFFT (Inverse Fast Fourier Transform), resulting in the resynthesis of the separated source. It will be appreciated that all of the above steps are performed on a frame by frame basis. In order to hear the separated source, the individual frames may be concatenated using a conventional overlap and add procedures familiar to those skilled in the art.

Once concatenated, the extracted source may be converted into analog form (e.g. using a digital to analog converter) and played back through a loudspeaker or similar output device.

There are a number of optional features which may be applied to improve the operation of the overall system and method.

The first of these optional features is a fundamental cut-off filter FIG. 1 (108). This fundamental cut-off filter may be used when a source to be separated is substantially pitched and monophonic (i.e. can only play one note at a time). Assuming the separation has been successful, the fundamental cut-off filter may be used to zero the power spectrum below the fundamental frequency of the note that the separated instrument is playing. This is simply because no significant frequency information for the instrument resides below its fundamental frequency. (This is true for the significant majority of cases). The result is that any noise or intrusions from other instruments in this frequency range may be suppressed. The use of this fundamental cut-off frequency filter results in greater signal to noise ratio for certain cases. This fundamental cut-off frequency filter (essentially a high pass filter having a cut-off frequency below the fundamental frequency) may be implemented as a separate filter in either the time domain or the frequency domain. Optionally, the use of this feature may be activated/deactivated by a user control 250 in the graphical user interface. Conveniently, the fundamental cut-off frequency may be performed by applying a technique such as that defined by the algorithm of Eq. 8 upon the 1×N array selected for resynthesis.

$$Y_{R(k)} = \begin{cases} Y_{R(k)} & \text{if } \delta \le k \ge N - \delta \\ 0, & \text{otherwise} \end{cases} \quad 1 \le k \le N \tag{8}$$

where δ is the bin number which contains the fundamental frequency and $1 \leqq \delta \leqq N/2$. The fundamental frequency may be considered to reside in the bin with the largest magnitude within a given frame.

A further optional feature which may be applied is a Harmonicity Mask 109. This optional feature may be activated/deactivated using a control in the graphical user interface 255. The harmonicity mask is an adaptive filter designed to suppress background noise and bleed from non-desired sources. Its purpose is to increase the output quality of a monophonic separation. For example, a separation will often contain artifacts from other instruments but these artifacts will usually be a few db lower in amplitude than the source, which has been successfully separated and thus less noticeable to a listener.

The Harmonicity Mask 109 uses the well-known principle that when a note is sounded by a pitched instrument, it normally has a power spectrum with a peak magnitude at the fundamental frequency and significant magnitudes at integer multiples of the fundamental. The frequency regions occupied by these harmonics are all that we need to faithfully represent a reasonable synthesis of an instrument. The exception to this is during the initial or 'attack' portion of a note which can often contain broadband transient like energy. The degree of this transient energy is dependent on both the instrument and force at which the note was excited. It has been shown through research that this attack portion is often the defining factor when identifying an instrument. The Harmonicity Mask 109 of the present invention will filter away all but the harmonic power spectrum of the separated source. In order to preserve the attack portions of the notes, a transient detector is employed. If a transient is encountered during a frame, the Harmonicity Mask 109 is not applied thus maintaining the attack portion of the note. The result of this is increased output quality for certain source separations.

The transient (onset) detector is applied to determine whether the harmonicity mask should be applied. If a transient or onset is detected, the harmonicity mask will not be applied. This allows for the attack portion of a note to bypass the processing of the harmonicity mask. Once the onset has passed the harmonicity mask may be switched back in. The onset detector works by determining an average energy for all the frequency bins. An onset is deemed to occur when the calculated average energy is above a pre-defined level. In mathematical terms, the onset detector may be described by Eq. 8.

$$\tau = \frac{\sum_{k=1}^{N} Y_{R(k)}}{N}. \tag{9}$$

The Harmonicity Mask 109 is then only applied if τ is less than a user specified threshold.

A first step in the Harmonicity Mask 109 is the determination of the bin location in which the fundamental frequency is located. One method of doing this starts from the assumption that the fundamental frequency is in the bin location exhibiting the greatest magnitude. A simple routine may then be used to determine the bin location with the greatest magnitude. For the purposes of the following explanation, we will refer to the bin with the fundamental frequency as $f_k$, which is an integer signifying the bin index. For reasons of accuracy, the process described below performs conversions between the discrete frequency values and their corresponding Hz equivalents. Although, simpler methods may be applied where such accuracy is not required.

This value, $f_k$, is then converted to an absolute frequency in Hz by first using quadratic estimation as shown in Eq. 10, the absolute frequency is then given in Eq. 11.

$$f_k' = f_k + \frac{(f_k + 1) - (f_k - 1)}{2((2 \times f_k) - (f_k - 1) - (f_k + 1)} \tag{10}$$

where $f_k$ is the bin index of the fundamental frequency.

$$F = f_k' \times \frac{fs}{N - 1} \tag{11}$$

where $f_s$ is the sampling frequency in Hz, and N is the FFT resolution.

The number of harmonics θ present, from and including the fundamental up to the Nyquist frequency, may be calculated using Eq. 12.

$$\theta = \frac{fs}{2F} \tag{12}$$

The frequencies of each of these harmonics, h(i), in Hz may be calculated using Eq. 12. Similarly, their corresponding bin indexes, hk(i), may be calculated using Eq. 13.

$$h_{(i)} = F \times i \quad 1 \le i \le \theta \tag{13}$$

$$h_{k(i)} = \frac{h_{(i)}}{\lambda} \quad \text{where } \lambda = \frac{fs}{N - 1} \tag{14}$$

Where I is the bin width for an N point FFT. The values in the array $h_{k(i)}$ are the bin indexes which will remain unchanged by the Harmonicity Mask. All other values will be zeroed. This is shown in Eq. 15.

$$Y_{R(k)} = \begin{cases} Y_{R(k)} & \text{if } k \in h_{k(i)} \\ 0, & \text{otherwise} \end{cases} \quad 1 \le k \le N/2 \tag{15}$$

In Avendano's model (described above), sources are subject to more interference as they deviate from the centre. No such interference exists in the technique of the present invention (ADRess), in fact the separation quality is likely to increase as the source deviates from the centre.

ADRess uses gain scaling and phase cancellation techniques in order to cancel out specific sources. At the point (for some gain scalar) where a source cancels, it will be observed that in the power spectrum of that channel (Left or Right), certain time frequency bins will drop in magnitude by an amount proportional to the energy which the cancelled source had contributed to the mixture. This energy loss is estimated and used as the new magnitude for source resynthesis. Effectively these magnitude estimations approximate the actual power spectrum of the individual source, as opposed to using the original mixture bin magnitudes as in the methods of Avendano and DUET.

It will be appreciated by those skilled in the art that once one or more sources have been extracted, they may be used either in isolation or mixed together to perform a variety of tasks in accordance with techniques well known in the art. It will further be appreciated that although the present system has been described with respect to the extraction of a single source, i.e. the contents at a particular azimuth window, it will be appreciated that the system may readily be adapted to simultaneously extract a plurality of sources simultaneously. For example, the system may be configured to extract the source contents for a plurality of different azimuths, which may be set by a user or determined automatically, and to output the extracted sources either individually or in a combined format, e.g. by up-mixing into a surround sound format.

It will further be appreciated that although the present invention has been described in terms of sound source separation from a source on a recording medium such as magnetic/optical recording medium, e.g. a hard disk or a compact disk. The invention may be applied to a real-time scenario where the sound sources are provided directly to the sound source separation system. In this context it will be appreciated that word recording may be taken to include a sound source temporarily and transiently stored in an electronic memory.

An example of such an application will now be described where two signals provided to the source separation system are obtained from two independent receivers, for example two microphones. This is inherent in the operation of the algorithm since it separates sources based on their location within a stereo field. The following are example applications of the invention although its application is not limited to these example.

Figure 5:
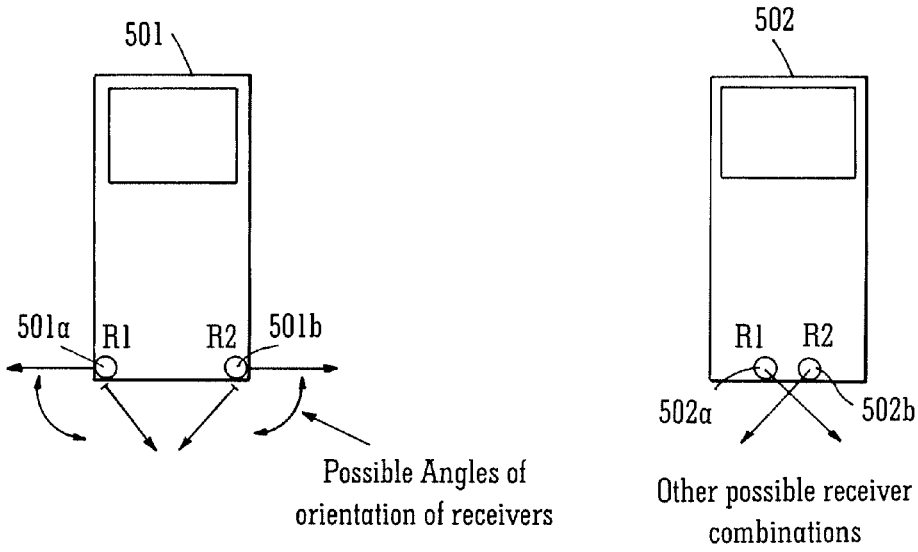
FIG. 5 shows two exemplary microphone arrangements on a mobile communications device according to the invention.

The invention may be used in the context of a communications device such as that of a mobile phone, in order to reduce unwanted background or environmental noise. In this scenario (as shown in FIG. 5), the communications device is provided with two acoustic receivers (microphones) 501*a* and 501*b* for device 501, and 502*a* and 502*b* for device 502. Each of the microphones provides a sound source (e.g. Left or Right) to a sound source separation system of the type described above. Suitably, the two microphones 501*a* and 501*b* are separated by some small distance in the order of about 1-2 cm as shown in the device 501. Preferably, the microphones are positioned on or about the same surface as shown in both devices 501 and 502. The positioning of the microphones should be such that both microphones are able to pick up a user's speech. Preferably, the microphones are arranged such that, in use, substantially similar intensities of user's speech is detected from both microphones. However, the acoustic receivers are suitably oriented at an angle relative to one another, in the range of approximately 45 to 180 degrees and preferably from 80 to 180 degrees. In device 501, the approximate relative angle is shown varying between 90 and 180 degrees, whereas in device 502 it is shown as 90 degrees. It will be appreciated that where the acoustic receivers comprise microphones, the microphones may be orientated or the channels feeding the audio signals to the microphones may be orientated to achieve the relative orientation.

The sound source separation of the invention may then be configured so that it will reproduce only signals originating from a specific location, in this case the location of the speaker's mouth, (speaker refers to the person using the phone). The system may be configured for use in a variety of ways. For example, the system may be pre-programmed with a predefined azimuth corresponding to the position of the user of the device. This system may also allow for the user to tune their device to a particular azimuth. For example, the system may be configured to allow a user to speak for a time. The system would suitably record the resultant signals from both microphones and allow the user to listen to the results as they vary the azimuth. Other variations would allow the user to switch the resultant noise reduction feature on or off. Similarly, the device may be adapted to allow the user to vary the width of the extraction window. The system may also be applied in a hearing aid using the dual microphone technique described. In this scenario, the ability to switch on/off the noise reduction feature may be extremely important, as it may be dangerous for a person to reduce all background noise.

In the latter examples, it will be appreciated that the invention works for one or more reasons including that the speaker will be the closest source to the receivers which implies that he/she will most likely be the loudest source within a moderately noisy environment. Secondly, the speaker's voice will be the most phase correlated source within the mixture due to the fact that the path length to each receiver will be shortest for the speaker's voice. The further away a source is from the receiver the less phase correlated it will be and so easier to suppress. One element of the invention is that the sources for extraction are phase correlated. In this case only the speaker's voice will have high phase correlation due to its proximity to the receivers and so can be separated from the noisy mixture.

Thus in effect, the signals obtained from the two receivers provide the input signals for the invention which may be used to perform the task of separating the speaker's voice from the noisy signals and output it as single channel signal with the background noise greatly reduced.

The method may also be applied to background noise suppression for use with other communications devices, including for example headsets. Headsets, generally comprising at least one microphone, and a speaker/ear piece, are typically used for transmitting and/or receiving sound to/from an associated device including, for example, a computer, a dicta phone or a telephone. Such headsets are connected directly by either wire or wireless to their associated device. A popular type of wireless headset employs BLUETOOTH to communicate with the associated device. For a headset to incorporate the noise reduction methods of the present invention requires that they have two sound transducers (microphones). Suitably, each microphone is mounted on/within the body of the headset. The microphones are suitably separated from each other by some small distance, for example, in the range of 1-3 cm. It will be appreciated that the design of the shape and configuration of the headset may affect the precise placement of each of the microphones.

As in the previous embodiments, each microphone will receive a slightly different signal due to their displacement. As the speaker's voice will be the source closest to the transducers, it will have the greatest phase coherence in the resulting signals from both microphones. This is in contrast to the background noise, which will be significantly less phase coherent due to acoustic reflections within the surrounding environment. These reflections will cause sources which are more distant to be less phase correlated and thus will be suppressed by the method of the present invention. As in the previous embodiments, the method of the invention as described above, employs the signals from each microphones as inputs and provides a single output having reduced background noise.

Figure 7:
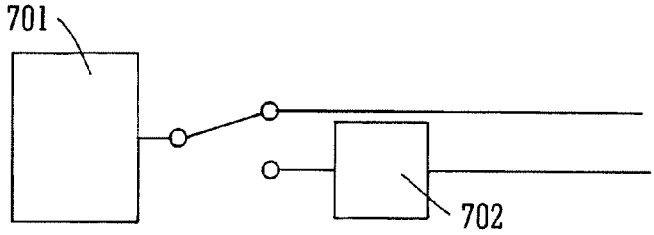
FIG. 7 illustrates a switching arrangement between a headset including acoustic receivers and an associated device including the sound analysis system according to the present teaching.

The method of the invention may be implemented within the hardware and software of the headset itself. This is particularly advantageous as it allows a user to replace their headset (to have noise reduction) without having to make any changes to the associated device. Although, the invention may also be implemented in the associated device, with the headset simply providing a stereo signal from the two microphones. FIG. 7 is a block diagram illustrating a headset 701 including acoustic receivers device and an associated device 702 including a sound analysis system according to the present teaching.

Figure 6A:
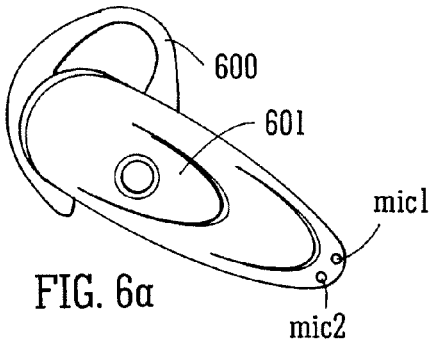
FIGS. 6*a* to 6*c* illustrate exemplary BLUETOOTH wireless headset configurations.
Figure 6B:
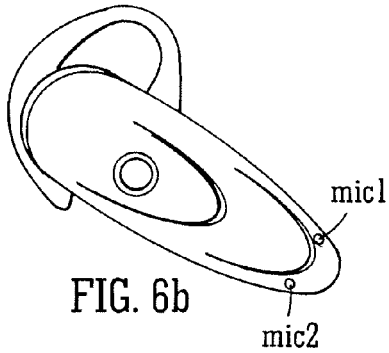
Figure 6C:
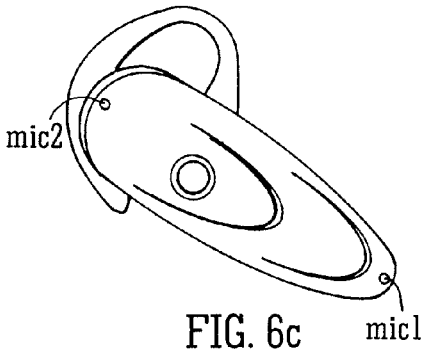

Although it will be appreciated that a variety of different microphone positions and configurations may be employed, optimum arrangements may readily be obtained by experiment and that the precise configurations and arrangements adopted will depend on the overall headset design. Nevertheless some exemplary BLUETOOTH wireless headset configurations are shown in FIGS. 6*a-c*. These headsets each comprise, a headset support 600, which allows the user to retain the headset on their ear and a main body 601. The main body 601 suitably houses the headset hardware (circuitry). As illustrated, a number of different microphone configurations are possible, including for example but not limited to:

1. As shown in FIG. 6*a*, where the microphones are positioned adjacent to one another at the opposite end of the headset to the support 600,
2. As shown in FIG. 6*b*, where both microphones are positioned on separate protrusions (similar to a swallow tail shape) from the opposite end of the headset to the support 600, and
3. As shown in FIG. 6*c*, where one microphone is positioned on the headset at the support end and the other microphone is positioned at the opposite end of the headset to the support 600.

Although, the present invention has been described with respect to a number of different embodiments, it will be appreciated that a number of variations are possible and that accordingly the present invention is not to be construed as limited to these embodiments. The present invention is intended to cover all variations which come within the scope and spirit of the claims which follow.

The words comprises/comprising when used in this specification are to specify the presence of stated features, integers, steps or components but does not preclude the presence or addition of one or more other features, integers, steps, components or groups thereof.

The invention claimed is:

1. A method of modifying a stereo recording for subsequent analysis, the stereo recording comprising a first channel signal and a second channel signal, the method comprising the steps of:

converting the first channel signal into the frequency domain, converting the second channel signal into the frequency domain, defining a set of scaling factors, producing a frequency azimuth plane by 1) gain scaling the frequency converted first channel signal by a first scaling factor selected from the set of defined scaling factors, 2) subtracting the gain scaled first channel signal from the frequency converted second channel signal, 3) repeating steps 1) and 2) individually for the remaining scaling factors in the defined set to produce the frequency azimuth plane, the frequency azimuth plane representing magnitudes of different frequencies for respective scaling factors and which can be used for subsequent analysis.

2. A method of modifying a stereo recording according to claim 1, wherein the step of producing the frequency azimuth plane comprises the further steps of 4) gain scaling the frequency converted second signal by the first scaling factor, 5) subtracting the gain scaled second signal from the frequency converted first signal, 6) repeating steps 4) and 5) individually for the remaining scaling factors in the defined set and combining the resulting gain scaled subtracted values with the previously determined gain scaled subtracted values in claim 1 to produce the frequency azimuth plane.

3. A method of analysing a stereo recording comprising the method of modifying the stereo recording according to claim 1, the method of analyzing comprising the step of displaying a graphical representation of the produced frequency azimuth plane to a user.

4. A method of modifying a stereo recording according to claim 1, further comprising the steps of determining a maximum value for each frequency in the frequency azimuth plane and subtracting individual frequency magnitudes in the frequency azimuth plane from the determined maximum values to produce an inverted frequency azimuth plane.

5. A method of analysing a stereo recording comprising the method of modifying the stereo recording according to claim 3, further comprising the step of displaying a graphical representation of an inverted frequency azimuth plane to a user, the inverted azimuth plane being defined by determining a maximum value for each frequency in the frequency azimuth plane and subtracting individual frequency magnitudes in the frequency azimuth plane from the determined maximum values.

6. A method of extracting a sound source from a stereo recording comprising the: method of modifying a stereo recording according to claim 4, the method of extracting comprising the step of applying a window to the inverted frequency azimuth plane to extract frequencies associated with a particular scaling factor.

7. A method of extracting a sound source from a stereo recording according to claim 6, further comprising the step of converting the extracted frequencies into a time domain representation.

8. A method according to claim 1, wherein said first channel signal is the LEFT signal in a stereo recording and said second channel signal is the RIGHT signal in the stereo recording or wherein said first channel signal is the RIGHT signal in a stereo recording and said second channel signal is the LEFT signal in the stereo recording.

9. A method according to claim 1, wherein the defined set of scaling factors is in a range between 0 and 1 in magnitude.

10. A method according to claim 1, wherein there is a uniform spacing between individual scaling factors.

11. A method of extracting a sound source from a stereo recording according to claim 7, further comprising the step of applying a threshold filter to reduce noise prior to conversion into the time domain.

12. A method according to claim 1, further comprising the initial step of breaking the first channel signal and the second channel signal into frames, wherein the individual steps of the method are then performed on a frame by frame basis.

13. A sound analysis system comprising:

an input module for accepting a first channel signal and a second channel signal, a first frequency conversion engine being adapted to convert the first channel signal into the frequency domain, a second frequency conversion engine being adapted to convert the second channel signal into the frequency domain, and a plane generator being adapted to gain scale the frequency converted first channel signal by a series of scaling factors from a previously defined set of scaling factors, subtract the gain scaled frequency converted first channel signals from the frequency converted second signal, and combining the resulting scale subtracted values to produce a frequency azimuth plane which represents magnitudes of different frequencies for each of the scaling.

14. A sound analysis system according to claim 13, wherein the input module comprises an audio playback device.

15. A sound analysis system according to claim 13 further comprising a graphical user interface for displaying the frequency azimuth plane.

16. A sound analysis system according to claim 14, wherein the plane generator is further adapted to gain scale the frequency converted second signal by a first scaling factor selected from the set of defined scaling factors and to subtract the gain scaled frequency converted second channel signal from the frequency converted first channel signal and to repeat this individually for the remaining scaling factors in the defined set and to combine the resulting gain scaled subtracted values with the previously determined gain scaled subtracted values in claim 18 to produce the frequency azimuth plane.

17. A sound analysis system to claim 13, further comprising first and second acoustic receivers, wherein the first channel signal and the second channel signal are each provided by the first and second acoustic receivers, respectively.

18. A system according to claim 17, configured to switch a signal output between an output from the first and second acoustic receivers and an output from the sound analysis system.

19. A system for providing an audio signal output comprising a sound analysis system according to claim 17.

* * * * *